US009422085B2

(12) United States Patent
Kemmer, Jr. et al.

(10) Patent No.: US 9,422,085 B2
(45) Date of Patent: Aug. 23, 2016

(54) MOVABLE MODULAR SYSTEM FOR STACKING FREIGHT

(71) Applicants: William Spencer Kemmer, Jr., Fort Lauderdale, FL (US); Darrin Labuda, Gresham, OR (US)

(72) Inventors: William Spencer Kemmer, Jr., Fort Lauderdale, FL (US); Darrin Labuda, Gresham, OR (US)

( * ) Notice: Subject to any disclaimer, the term of this patent is extended or adjusted under 35 U.S.C. 154(b) by 0 days.

(21) Appl. No.: 14/723,950

(22) Filed: May 28, 2015

(65) Prior Publication Data

US 2015/0344175 A1 Dec. 3, 2015

Related U.S. Application Data

(60) Provisional application No. 62/004,729, filed on May 29, 2014.

(51) Int. Cl.
*B65D 19/38* (2006.01)
*B65D 19/00* (2006.01)

(52) U.S. Cl.
CPC ..... *B65D 19/385* (2013.01); *B65D 19/0012* (2013.01); *B65D 19/0095* (2013.01); *B65D 2519/00019* (2013.01); *B65D 2519/00024* (2013.01); *B65D 2519/00029* (2013.01); *B65D 2519/00034* (2013.01); *B65D 2519/00054* (2013.01); *B65D 2519/00059* (2013.01); *B65D 2519/00064* (2013.01); *B65D 2519/00069* (2013.01); *B65D 2519/00089* (2013.01); *B65D 2519/00094* (2013.01); *B65D 2519/0097* (2013.01); *B65D 2519/00099* (2013.01); *B65D 2519/00104* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00343* (2013.01); *B65D 2519/00572* (2013.01); *B65D 2519/00781* (2013.01); *B65D 2519/00786* (2013.01); *B65D 2519/00865* (2013.01)

(58) Field of Classification Search
CPC ..... B65D 2519/0097; B65D 2519/00935; B65D 2519/0094; B65D 2519/0096; B65D 2519/00955; B65D 2519/00965
USPC ..... 108/53.1, 53.3, 53.5, 51.11
See application file for complete search history.

(56) References Cited

U.S. PATENT DOCUMENTS 3,327,654 A * 6/1967 Duncan ..... B65D 19/12 108/53.1
3,667,403 A 6/1972 Angelback, Jr.
4,673,092 A * 6/1987 Lamson ..... A47B 47/028 108/53.1
4,703,702 A * 11/1987 Speicher ..... B65D 19/385 108/52.1
5,137,165 A * 8/1992 Friman ..... B65D 19/14 206/511
5,507,237 A * 4/1996 Barrow ..... B65D 19/08 108/53.1

(Continued)

*Primary Examiner* — Jose V Chen

(57) ABSTRACT

A system for stacking freight within a shipping container is disclosed. The system comprises a first pallet configured to be removably affixed below and have vertical relief from a second pallet when the system is in a fully assembled state. The system also includes a second pallet configured to be removably affixed on top of and have vertical relief from the first pallet. The system also includes a plurality of support members vertically arranged to support the second pallet on top of the first pallet and provide vertical relief between the first and second pallets when the movable modular system is in the fully assembled state. A plurality of fasteners are used to removably attach the ends of crossing support members to the vertically arranged support members when the system is in the fully assembled state.

16 Claims, 7 Drawing Sheets

(56) References Cited

U.S. PATENT DOCUMENTS 5,598,787 A * 2/1997 Pronk ..... B65D 19/385 108/51.3
5,918,551 A * 7/1999 Liu ..... B65D 19/10 108/53.1
6,186,077 B1 * 2/2001 Lim ..... B65D 19/0095 108/56.1
6,202,569 B1 * 3/2001 Bailey ..... B65D 19/0026 108/53.1
6,286,792 B1 * 9/2001 Best ..... B65D 19/08 108/53.1
6,463,863 B1 * 10/2002 Ishikawa ..... B65D 19/385 108/53.1
7,997,213 B1 * 8/2011 Gauthier ..... B65D 88/022 108/53.1
2004/0251254 A1 * 12/2004 Junge ..... B65D 19/18 220/4.28
2005/0000929 A1 * 1/2005 Dunn ..... B65D 19/12 211/194
2006/0011625 A1 * 1/2006 Arnold ..... B65D 19/18 220/6
2008/0135506 A1 * 6/2008 Peters ..... B65D 19/10 211/49.1
2009/0057191 A1 * 3/2009 Temple, Jr. ..... B65D 19/12 206/600
2011/0303129 A1 * 12/2011 Harris ..... B65D 19/08 108/53.1
2013/0145971 A1 6/2013 Federl et al.
2013/0228574 A1 * 9/2013 Hill ..... B65D 77/061 220/9.2
2015/0158629 A1 * 6/2015 Harris ..... B65D 19/385 108/53.3

* cited by examiner

MOVABLE MODULAR SYSTEM FOR STACKING FREIGHT

CROSS-REFERENCE TO RELATED APPLICATIONS

This application claims the benefit of the filing date of U.S. Provisional Application Ser. No. 62/004,729 filed May 29, 2014 and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of shipping, and more specifically, the field of packing freight for shipping.

BACKGROUND

The shipping industry is a multi-billion-dollar industry. Almost every country in the world exports and imports goods to other countries. Additionally, within each country goods are shipped from one part of a country to another. In many cases, goods are shipped in shipping containers that are standardized in size. Containerization for transport has spurred the use of pallets.

A pallet, sometimes called a skid, is a flat transport structure that supports goods in a stable fashion while being lifted by a forklift, pallet jack, front loader, jack, or other jacking or lifting device. Many pallets are wooden, however, pallets may also be made from plastic, metal, paper and recycled papers. Pallets are used to load goods in shipping containers because the shipping containers have the smooth, level surfaces needed for easy pallet movement. Most pallets can easily carry a load of 1,000 kg (2,205 lb). Today, over half a billion pallets are made each year and about two billion pallets are in use across the United States alone. Businesses using standard pallets for loading and unloading can have much lower costs for handling and storage, with faster material movement than businesses that do not.

In operation, goods, freight or other smaller containers are often placed on a pallet then secured with strapping, stretch wrap or shrink wrap. After securing the freight or goods to the pallet, a loading device, such as a jack or front loader, loads or moves the loaded pallet into a shipping container for shipping.

However, the use of existing pallets has its limitations. One of the biggest limitations is that it is the use of existing pallets creates a large amount of under or unutilized space within a shipping or movable container. Typically, the inside of a shipping container has a height that is much higher than a height of goods stacked and secured on a pallet. As a result, when a pallet is loaded, by using a forklift, jack etc., into a shipping container, the space between the top of the inside of the shipping container and the top of the freight loaded on the pallets is empty and not used. As a result, when using existing pallets movable containers or shipping containers are transported with a significant amount of the upper portion of the container underutilized or not filled with goods. Due to such inefficiencies, transportation and fuel costs are increased.

As a result, there exists a need for improvements over the prior art and more particularly for a more efficient way storing goods in movable containers to better utilize the space of such shipping or movable containers.

SUMMARY

A system for stacking freight within a shipping container is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for stacking freight within a shipping container is disclosed. The system comprises a first pallet configured to be removably affixed below and have vertical relief from a second pallet when the system is in a fully assembled state. The first pallet includes a first pallet top planar part having a plurality of orifices proximate to a perimeter of the first pallet top planar part. The first pallet also includes a first pallet bottom planar part having a plurality of apertures. The apertures are configured to allow a set of wheels of a lifting device to contact ground. A plurality of blocks is affixed between the first pallet top and bottom planar parts. Each block has a cutout adapted to correspond with the orifices of the first pallet top planar part, and wherein the plurality of blocks provide vertical relief between the first pallet top and bottom planar parts so that the forks of a lifting device can be positioned between the top and bottom planar parts of the first pallet.

The system also includes a second pallet configured to be removably affixed on top of and have vertical relief from the first pallet. The second pallet comprises a second pallet top planar part. The second pallet bottom planar part having a plurality of orifices proximate to a perimeter of the second pallet bottom planar part, and further comprising a plurality of apertures inward from the plurality of orifices. The apertures are configured to allow a set of wheels of a lifting device to contact ground. A plurality of blocks is affixed between the second pallet top and bottom planar parts. Each block has a cutout adapted to correspond with the orifices of the second pallet bottom planar part, and wherein the plurality of blocks provide vertical relief between the second pallet top and bottom planar parts of the second pallet such that the forks of a lifting device and be positioned between the top and bottom planar parts of the second pallet.

The system also includes a plurality of first vertical support members, wherein each first vertical support member comprises an elongated body having a first end opposing a second end, wherein the first end of each first vertical support member is configured to be received by the orifices and corresponding cutouts of the first pallet, wherein the second end of each first vertical support member is configured to be received by the orifices and corresponding cutouts of the second pallet, and wherein the first vertical support members are configured to be vertically arranged to support the second pallet on top of the first pallet and provide vertical relief between the first and second pallets when the movable modular system is in the fully assembled state. The system also includes a plurality of crossing support members, each crossing member comprising an elongated body having a first end opposing a second end and wherein each crossing member is adapted to span from proximate to the first end of a vertical support member to proximate to the second end of an adjacent vertical support member when the system is in the fully assembled state. A plurality of fasteners are used to removably attach the ends of the crossing support members to the first support members when the system is in the fully assembled state.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
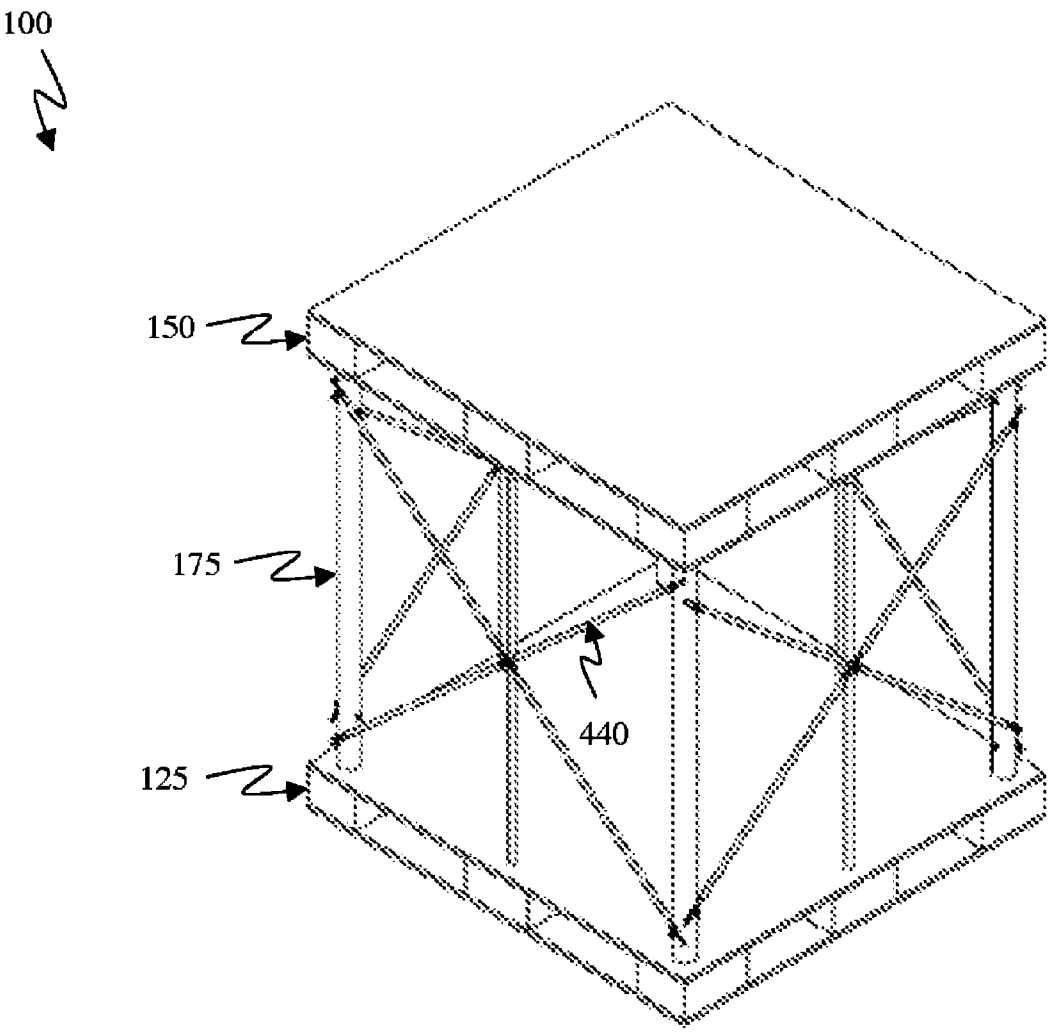
FIG. 1 is a perspective view of a movable modular system in a fully assembled state for stacking freight within a shipping container, according to one non-limiting embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a movable modular system for stacking freight within a shipping container. The present embodiments improve over the prior art by providing a system that allows multiple pallets to the stacked on top of one of another within a shipping container. The present embodiments also improve over the prior art by providing a system that can be disassembled into smaller components and easily assembled. The present embodiments also improves over the prior art by providing a system that can be utilized with standardized shipping or moving containers as well as standardized lifting devices, such as fork lifts, front loaders, jacks, etc. The present embodiments allow significantly more utilization of shipping containers thereby decreasing shipping costs to consumers.

Referring now to the Figures, FIG. 1 is a perspective view of the movable modular system 100 for stacking freight within a shipping container. A shipping container is a container with strength suitable to withstand shipment, storage, and handling. Shipping containers range from large reusable steel boxes used for intermodal shipments to small corrugated boxes. Shipping containers can vary in their shapes and sizes. The size of the system and more specifically the size of the first and second pallets and support members can be configured to maximize the utilization of space within the shipping container.

In FIG. 1 the system 100 is in a fully assembled state. The system includes a first pallet 125 configured to be removably affixed below and have vertical relief from a second pallet 150 when the system is in the fully assembled state. The plurality of support members, including first vertical support members 175, support the second pallet on top of the first pallet and provide vertical relief between the second and first pallets. As will be explained further below, the first pallet has a first pallet top planar part 205 having a flat surface that is configured for receiving freight. In the present embodiment, a pallet having four sides may be used. However, other shaped pallets may also be used. Similarly, the second pallet may have a second pallet top planar part 240 having a flat surface and is configured for receiving freight. In the present embodiment, a pallet having various sizes may be used. The first and second pallets may be blocked pallets, stinger pallets, four way pallet etc. The pallet may be a four-way pallet such that a pallet jack or other lifting device may be used from any side to move the pallet from one location to another. In the present embodiment, the first and second pallets have four sides.

Figure 2B:
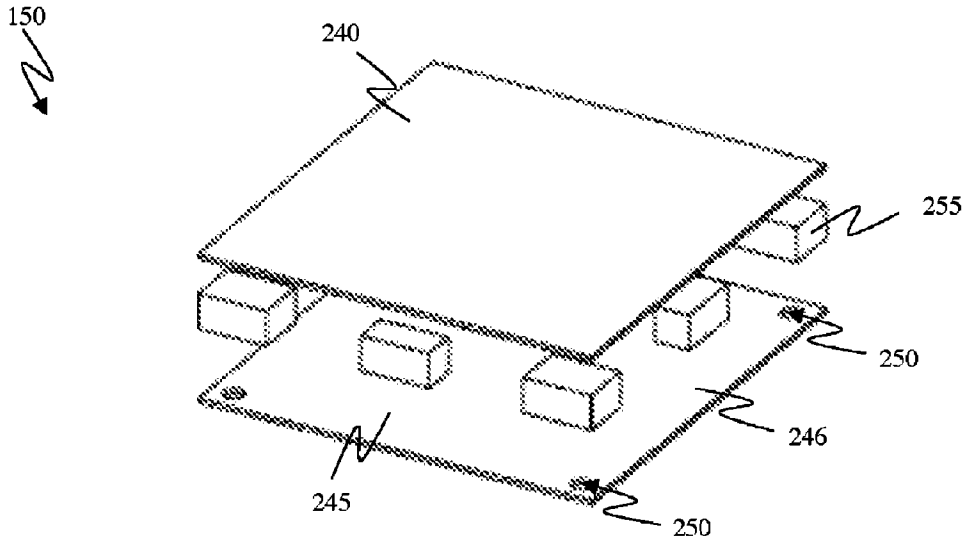
FIG. 2B is a perspective exploded view of a second pallet of the movable modular system, according to one non-limiting embodiment.
Figure 2A:
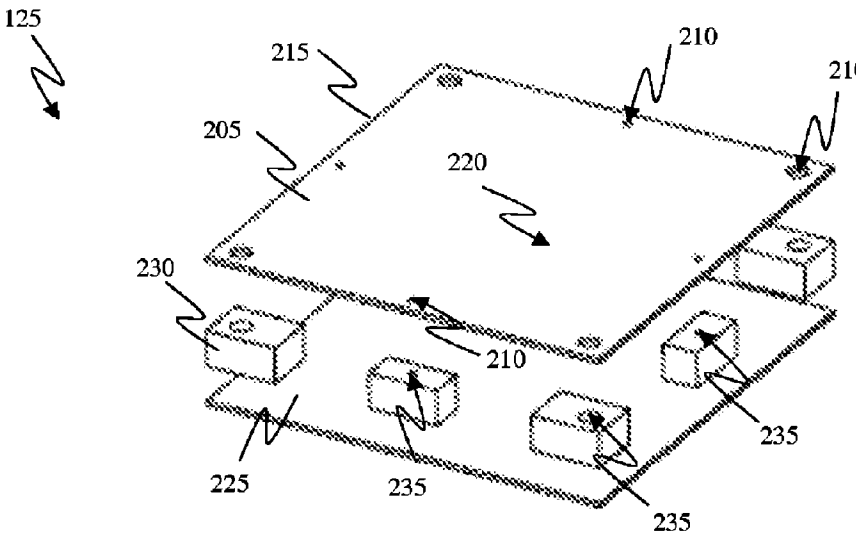
FIG. 2A is a perspective exploded view of a first pallet of the movable modular system, according to one non-limiting embodiment.

FIG. 2A is a perspective exploded view of a first pallet 125 of the movable modular system 100, according to one non-limiting embodiment. The first pallet is configured to be removably affixed below and have vertical relief from a second pallet 150 when the system is in a fully assembled state. The first pallet may comprise a first pallet top planar part 205 affixed to a first pallet bottom planar part 225 by blocks 230. The first pallet top planar part is a planar shaped body having a plurality of orifices 210 proximate to a perimeter 215 of the first pallet top planar part. The first pallet top planar part as an upward facing surface configured for receiving freight. Each block affixed between the first pallet top and bottom planar parts has a cutout 235 configured to correspond with the orifices 210 of the first pallet top planar part. The area of the first pallet top planar part inward from the orifices proximate to the perimeter of the top planar part is configured for receiving freight when the system is in the fully assembled state. The shape and size of the orifices and cutouts of the first pallet are adapted to receive the first end 410 of the first vertical support members (further explained below and illustrated in FIGS. 4 and 5). The plurality of blocks provide vertical relief between the first pallet top and bottom planar parts. Each block is a solid body. Each block may be affixed by welding, glue, fasteners, (or any combination thereof) or may be integral with to the first pallet top and bottom planar parts. In the present embodiment, three blocks are positioned on each side of the first pallet proximate to the perimeter of the pallet. A block is positioned at each corner of the pallet and at a midpoint between each corner. The blocks provide vertical relief between the first pallet top planar part and bottom planar part and are positioned and sized such that the forks of a pallet jack, lifting device, forklifts, front loader etc. can be positioned in between the top and bottom first pallet planar parts in order to move the first pallet. The blocks are also positioned such that the forks of a forklift or pallet jack can enter into the space between the top and bottom planar parts of the pallet from every side of the pallet. This allows the lifting device to be able to lift to the pallet from any side. Further, as explained below additional blocks may be positioned proximate to a center point of the pallet if necessary to receive an end of additional vertical member for heavier loads on the second pallet.

FIG. 2B is a perspective exploded view of a second pallet 150 of the movable modular system, according to one non-limiting embodiment. The second pallet is configured to be removably affixed on top of and have vertical relief from the first pallet 125. The second pallet comprises a second pallet top planar part, blocks and a second pallet bottom planar part. The second pallet top planar part is a planar body having a flat surface adapted for receiving freight. The second pallet bottom planar part has a planar shaped body having a plurality of orifices 250 proximate to a perimeter 246. The shape and size of the orifices and cutouts of the second pallet are adapted to receive the first end 410 of the first vertical support member (further explained below and illustrated in FIGS. 4 and 5). A plurality of blocks 255 are affixed between the second pallet top and bottom planar parts. Each block is a solid body. Each block may be affixed by welding, glue, fasteners, (or any combination thereof) or may be integral with to the second pallet top and bottom planar parts. Each block has the cutout (illustrated in FIG. 6 as 605) that is adapted to correspond with the orifices 250 of the second pallet bottom planar part. Similar to the first pallet, in the present embodiment, three blocks are positioned on each side of the second pallet proximate to the perimeter of the second pallet. In one embodiment a block is positioned at each corner of the pallet and at a midpoint between each corner. The blocks provide vertical relief between the second pallet top planar part 240 and bottom planar parts and are positioned and sized such that the forks of a pallet jack, lifting device, forklifts, front loader etc. can be positioned in between the top and bottom second pallet planar parts in order to move the second pallet. The blocks are also positioned such that the forks of a forklift or pallet jack can enter into the space between the top and bottom planar parts of the pallet from every side of the pallet. This allows the lifting device to be able to lift the pallet from any side.

Figure 3B:
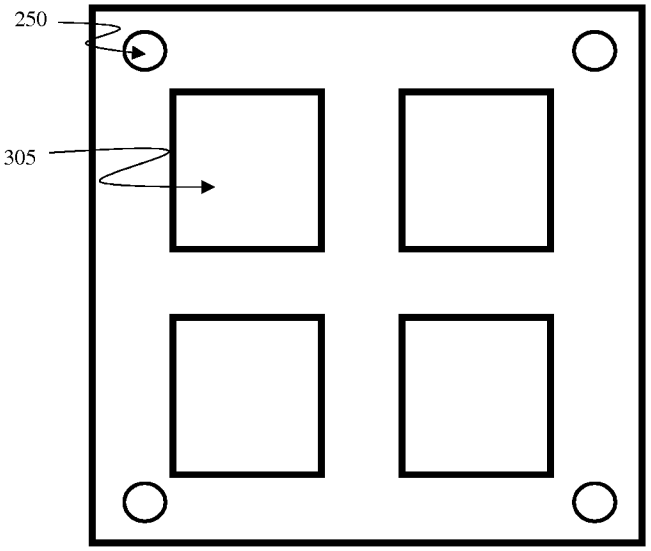
FIG. 3B is a bottom view of the second pallet of the movable modular system having apertures for allowing wheels of a lifting device to touch ground, according to one non-limiting embodiment.
Figure 3A:
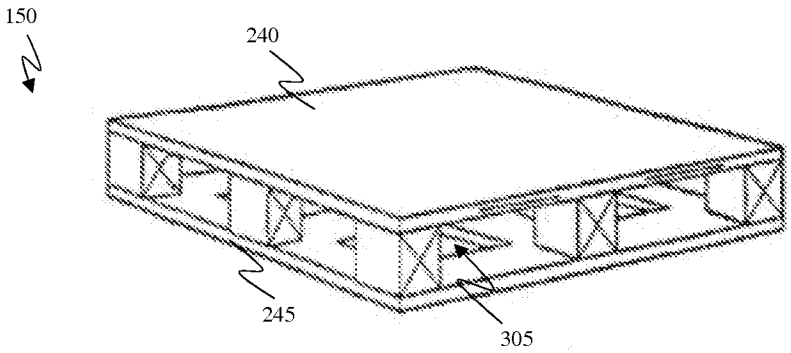
FIG. 3A is a perspective view of the second pallet of the movable modular system having apertures for allowing wheels of a lifting device to touch ground, according to one non-limiting embodiment.

FIG. 3A is a perspective view and FIG. 3B is a side view of the second pallet 150 of the movable modular system having apertures 305 for allowing wheels of a lifting device to touch ground, according to one non-limiting embodiment. In the present embodiment, four square shaped apertures 305 are positioned inward from the plurality of orifices 250 of the second pallet bottom planar part 245. The apertures are configured to allow a set of wheels of a lifting device (such as a pallet jack) to contact ground. Similarly, four square shaped apertures (not shown) are positioned inward from the plurality of orifices 210 of the first pallet bottom planar part 225, which are configured to allow a set of wheels of the lifting device (such as a pallet jack) to contact ground. In operation, when a user desires to move either the first or second pallet, a user may first insert the forks of a forklift into the space between the top and bottom planar parts of the pallet. Next, after inserting the forks, the user can then raise the forks in order to move the pallet from one position to another. When a user desires to move either the first or second pallet using a pallet jack, the user first insert the forks between the top and bottom planar parts of the pallets. Next, the user can adjust the wheels or rollers of the pallet jack into the openings or apertures of the bottom planar part. Next a user can raise the forks in order to move the pallet from one position to another.

Figure 4:
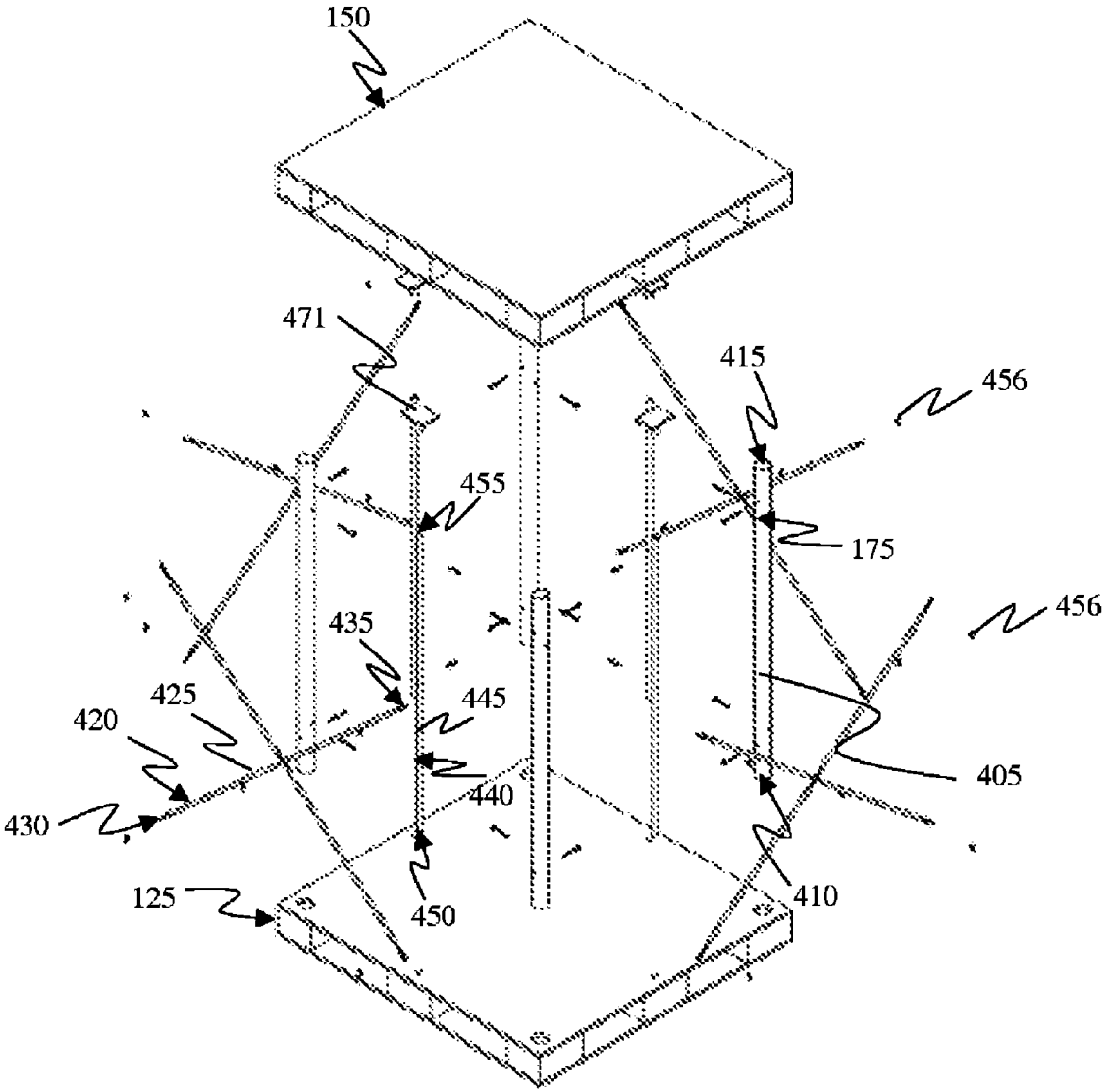
FIG. 4 is an perspective exploded view of the movable modular system for stacking freight in the fully assembled state, according to one non-limiting embodiment.
Figure 5:
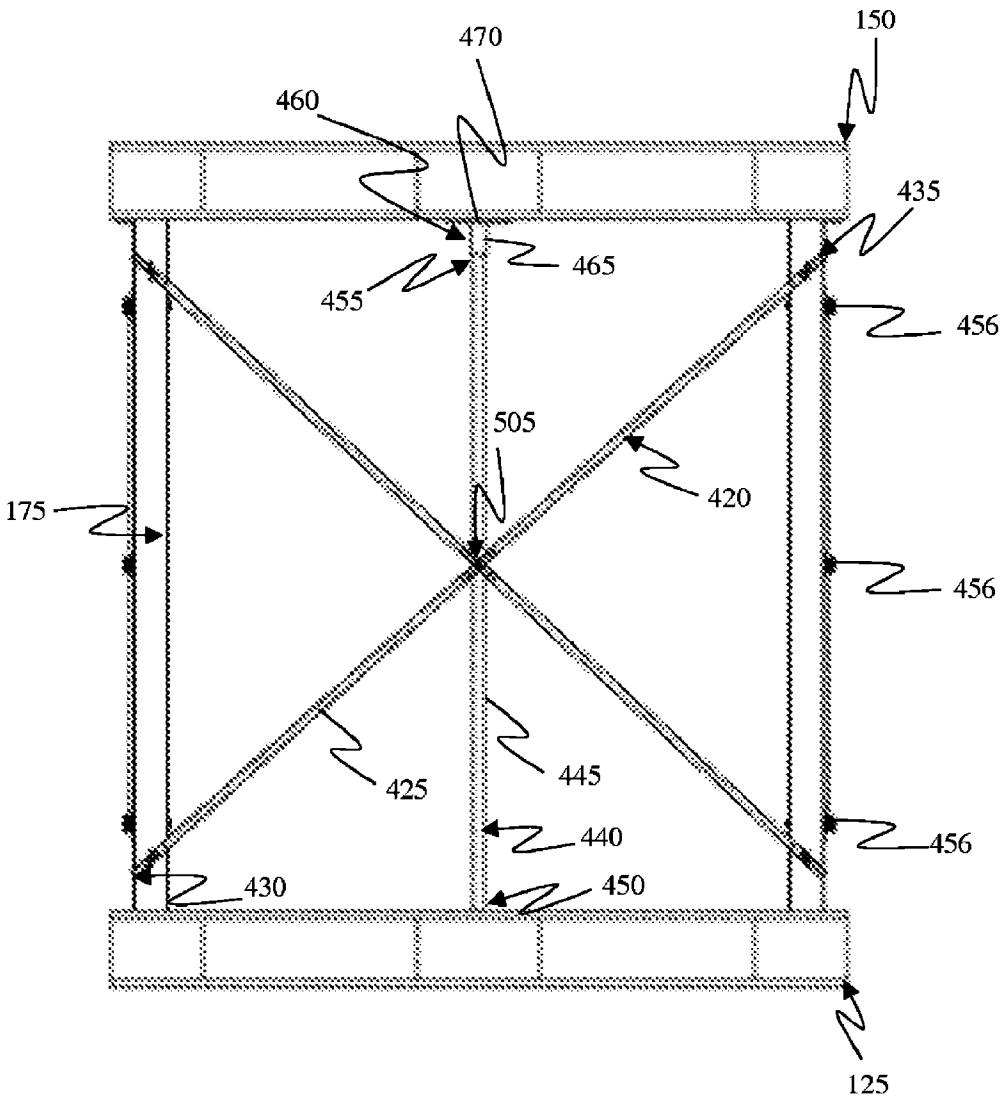
FIG. 5 is a side view of the movable modular system in the fully assembled state, according to one non-limiting embodiment.

Referring now to FIGS. 4 and 5, FIG. 4 is a perspective exploded view of the movable modular system 100 for stacking freight, according to one non-limiting embodiment and FIG. 5 is a side view of the movable modular system in the fully assembled state, according to one non-limiting embodiment. FIGS. 4 and 5 illustrate the plurality of support members that support the second pallet 150 on top of the first pallet 125 and that also provide vertical relief between the first and second pallets. In one embodiment, the support members may include four first vertical support members 175. Each first vertical support member comprises an elongated body 405 having a first end 410 opposing a second end 415. Each first end of each first vertical support member is configured to be received by the orifices 210 and corresponding cutouts 235 of the first pallet. The second end of each first vertical support member is configured to be received by the orifices 250 and corresponding cutouts 650 of the second pallet. When in the fully assembled state (illustrated in FIG. 5) the first vertical support members are configured to be vertically arranged to support the second pallet on top of the first pallet and provide vertical relief between the first and second pallets when the movable modular system is in the fully assembled state.

In one embodiment the support members may also include a plurality of crossing support members 420 to provide additional support to the second pallet on top of the first pallet when the system is in the fully assembled state. Each crossing member may comprise an elongated body 425 having a first end 430 opposing a second end 435. Each crossing member is adapted to span from proximate to the first end 410 of a first vertical support member to proximate to the second end 415 of an adjacent vertical support member when the system is in the fully assembled state. A plurality of fasteners 456 are used to removably attach the ends of the crossing support members to the first support members. In one embodiment, when in the fully assembled state each side of the system comprises two crossing members affixed by fasteners to adjacent first vertical support members. The crossing members may form an x-shape spanning adjacent first vertical support members. Additionally, the crossing members may be removably affixed to each other at a midpoint 505 of each crossing member by fasteners.

In one embodiment, the support members may also include a plurality of second vertical support members 440 to provide additional support to the second pallet on top of the first pallet when the system is in the fully assembled state. Each second vertical support member may comprise an elongated bar shape body 445 having a first end 450 opposing a second end 455. Each second vertical support member is configured to be vertically arranged at a midpoint between adjacent first vertical support members when the system is in the fully assembled state. In one embodiment, four second vertical support members may be used when the system is in the fully assembled state. The first end 450 of each second vertical support member is configured to be received by an orifice 210 and corresponding cutout 235 of the first pallet. In the present embodiment, the cross-sectional diameter of the second vertical support member is smaller than the diameter of the first vertical support member. However, it should be noted that various sizes of diameters of the support members can be used and the second vertical support member may have the same or larger diameter as the first vertical support member. The sizes of the orifices and corresponding cutouts of the first pallet will be adapted to receive the various sizes of the cross-sectional diameters of the first ends of both the first and second vertical support members. Additionally, the sizes of the orifices and corresponding cutouts of the first and second pallets will be adapted to receive the various sizes of the cross-sectional diameters of both the first and second vertical support members.

In one embodiment, the second end of each second vertical support member 450 is configured to be received by a capping member 460, which capping member is adapted to abut the downward facing surface of the bottom planar part of the second pallet in order to provide additional support and prevent movement of the system. Each capping member comprises a receiving part 465 configured to receive the second end of the second vertical support member. In the present embodiment, the receiving parts of the capping member comprise a body defining a cylindrical shaped cavity adapted to receive the cylindrical shape of the second vertical support member. However, other shapes for receiving part of the capping member can also be used. The capping member further comprises a planar part 470 adapted to abut a downward facing surface of the second pallet bottom planar part when the system is in the fully assembled state. When in the fully assembled state, the capping member provide additional support and prevents the movement of system when forces, other than downward forces, act on the system.

Additionally, when in the fully assembled state, the second vertical support members may be removably attached proximate to the midpoint 505 of the crossing members by fasteners to provide additional support and stability.

In one embodiment, in a fully assembled state, the system includes the second pallet 150 positioned on top the first pallet 125, wherein the support member provide vertical relief and support the second pallet. The support members include four first vertical members 175. Each first vertical support member is vertically arranged proximate to a corner of the system between the top and bottom pallets. The first end of each first vertical member is received by orifices and corresponding cutouts in the first pallet and the second end is received by the orifices and corresponding cutouts in the second pallet. In one embodiment, the system also includes four second vertical support members 440, each second vertical support member is vertically arranged between two adjacent first vertical members. The first end of the second vertical support member is received by orifices and corresponding cutouts in the first pallet and wherein the second end of each second vertical support member is received by a capping member 460. The four capping members used with the system each have a receiving part or section received by the second ends of the second vertical support members, and a planar part having an upward facing surface that is configured to abut the downward facing surface of the second pallet bottom planar part. In one embodiment, eight crossing members 420 are used when the system is in a fully assembled state. Two crossing members on each side of the system form an x-shape spanning adjacent first vertical support members. Each pair of crossing members are removably affixed to each other at the midpoint of each crossing member. Each crossing member may also be affixed to the midpoint of the body of each second vertical support member by fasteners. Additionally, each end of each crossing member may be affixed to an end of the first vertical support members by fasteners.

In operation, freight may be positioned on the upward facing surface of the top planar section of the first pallet inward from the plurality of 210 orifices. Worth noting is that the freight must be positioned in an area inward from the orifices 210 so as to allow the first ends of the support members (first vertical support member 175, second vertical support member 440) to be positioned into the orifices and corresponding cutouts of the first pallet. The freight may then be shrink-wrapped or secured for shipment. Such shrink wrapping or securing for shipment is well known to those skilled in the art. Next, the freight may be secured using straps or other means to the first pallet. In one embodiment, the first pallet may include features for allowing straps to be secured onto the first pallet to assist in securing freight. Such features may include orifices, apertures, hooks, knobs, etc and are well known to those skilled in the art. Additionally, other embodiments may also be used and are within the spirit and scope of the present invention. Next a lifting device can be used to move (as explained above) the first pallet with freight into a shipping container.

Next, freight may be positioned on top of the upward facing surface of the top planar part of the second pallet. The freight may then be shrink-wrapped or secured for shipment. Such shrink wrapping or securing for shipment is well known to those skilled in the art. Next, the freight may be secured using straps or other means to the second pallet. In one embodiment, the second pallet may include features for allowing straps to be secured onto the second pallet to assist in securing freight. Such features may include orifices, apertures, hooks, knobs, etc and are well known to those skilled in the art. Additionally, other embodiments may also be used and are within the spirit and scope of the present invention.

Next, the first ends of the first and second vertical support members can easily and quickly be positioned into the orifices and corresponding cutouts of the first pallet. Next, the crossing members may be affixed to the first and second vertical support members. Next, the capping members may be secured on top of the second end of the second vertical support members. Next, a lifting device can use its forks so that the second pallet may be positioned on top of the first pallet and support members so that the second ends of the first vertical supports members are received by the orifices 250 and corresponding cutouts 605 of the second pallet and the planar part of the capping members abuts the downward surface of the second pallet bottom planar part.

The support members, including the first vertical support member, second vertical support member, capping member and crossing members may be affixed to each other ahead of time to decrease the amount of time it takes to assemble the system.

In other embodiments, (further explained below and illustrated in FIG. 7) an additional vertical support member may be used proximate to a center point of the first and second pallets to provide additional support to the freight positioned on top of the second pallet. When such additional support members are used, traditional corresponding orifices and cutouts in the first and second pallets may be used. Additionally, an additional block with a cutout may also be used to receive the ends of the additional vertical support member.

Figure 6:
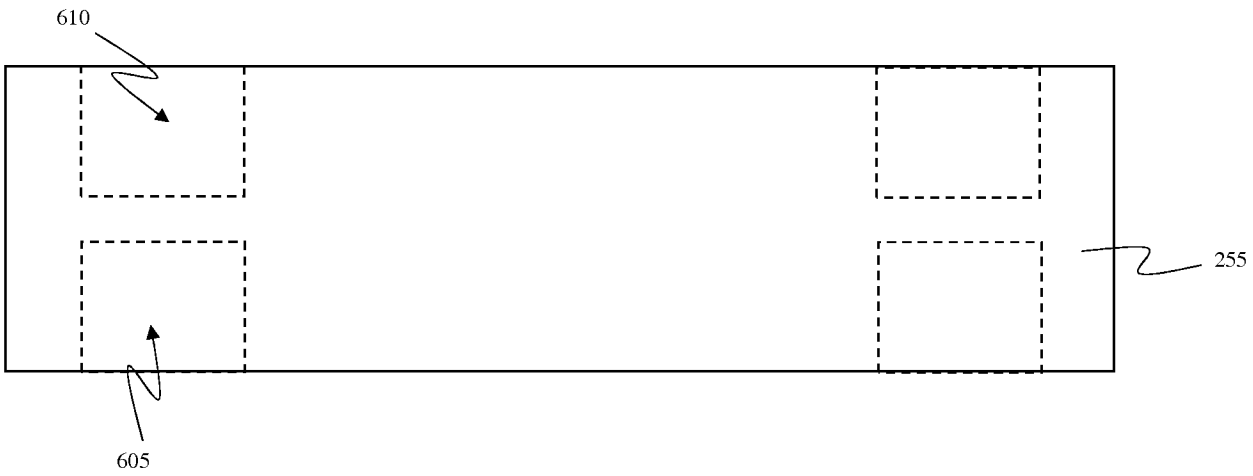
FIG. 6 is a side view of a block of the second pallet of the movable modular system, according to one non-limiting embodiment; and, FIG. 7 is a perspective view of the first pallet of the system having a top planar part removed, according to one non-limiting embodiment.

In other embodiments, additional pallets may be used (not shown). For example, a third pallet may be used in order to better utilize space if needed. In such an embodiment, a plurality of orifices proximate to a perimeter of the second pallet top planar part is needed. Additionally, each of the plurality of blocks 255 affixed between the second pallet top and bottom planar parts have a second cutout 610 to correspond with the orifices (not shown) of the second pallet top planar part as illustrated in FIG. 6.

The third pallet (not shown) can be configured to be removably affixed on top of and have vertical relief from the first and second pallets. Similar to the second pallet, the third pallet comprises a third pallet top planar part and a bottom planar part separated by blocks. The third pallet bottom planar part has a plurality of orifices proximate to a perimeter of the third pallet bottom planar part. The third pallet bottom planar part further comprises a plurality of apertures inward from the plurality of orifices. The apertures are configured to allow a set of wheels of a lifting device to contact ground so that the third pallet can be moved. Similar to other pallets, the plurality of blocks affixed between the third pallet top and bottom planar parts each have a cutout adapted to correspond with the orifices of the third pallet bottom planar part, and wherein the plurality of blocks provide vertical relief between the third pallet top and bottom planar parts so that the forks of a lifting device can be positioned between the top and bottom planar parts of the third pallet.

When a third pallet is used with the system, a plurality of supplemental first vertical support members are also needed. Like the first vertical support member, each supplemental first vertical support member comprises an elongated body having a first end opposing a second end. The first end of the supplemental first vertical support members are configured to be received by the orifices and corresponding second cutouts 610 of the second pallet (as illustrated in FIG. 6). The second end of each supplemental first vertical support member is configured to be received by the orifices and corresponding cutouts of the third pallet. The supplemental first vertical support members are configured to be vertically arranged to support the third pallet on top of the second pallet and provide vertical relief between the second pallet when the system is in the fully assembled state. A plurality of supplemental crossing support members may also be used if a third pallet is used with the system. Each supplemental crossing member may comprise an elongated body having a first end opposing a second end. Each supplemental crossing support member is adapted to span from proximate the first end of the supplemental first vertical support member to proximate to the second end of an adjacent supplemental first vertical support member when the system is in the fully assembled state.

Figure 7:
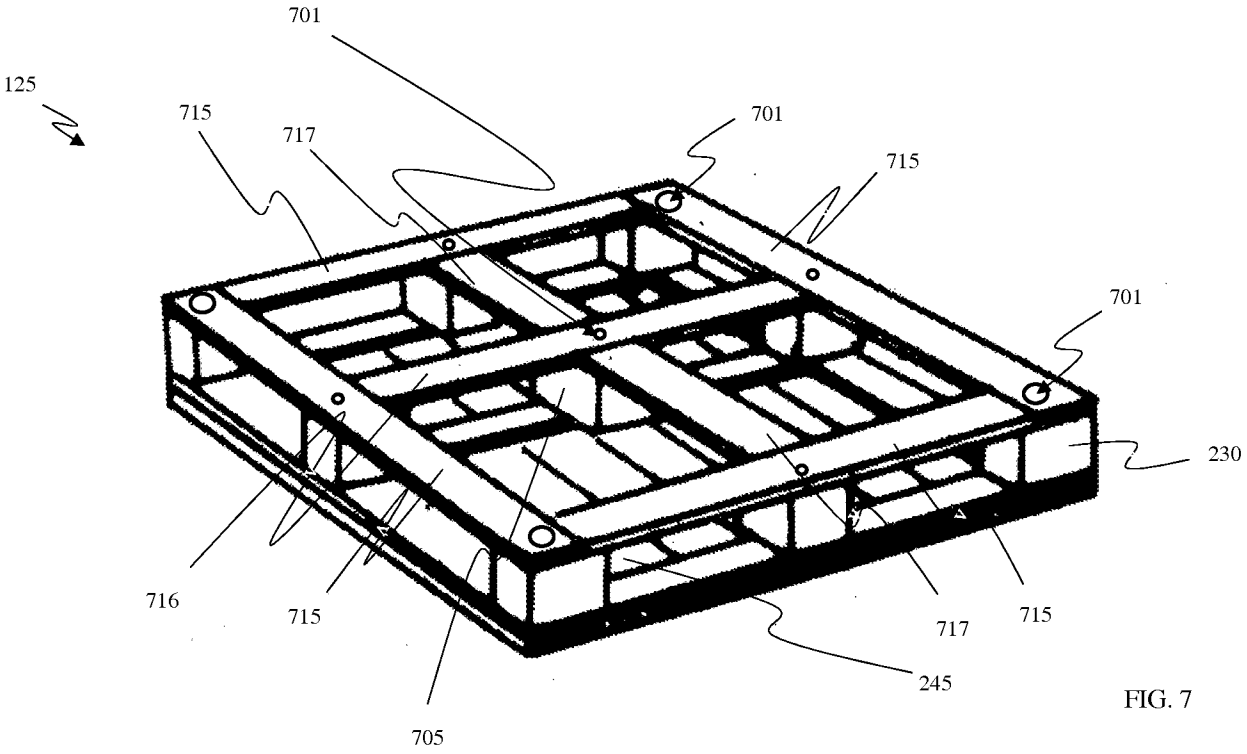

FIG. 7 is a perspective view of the first pallet 125 of the system having the top planar 205 part removed, according to one non-limiting embodiment. In FIG. 7, one of the plurality of blocks 705 is positioned proximate to a center point of the first pallet in addition to blocks positioned proximate to the perimeter. Similar to the other blocks, block 705 has a cutout adapted for receiving an end of a support member. The support member can be either the first or second vertical support member. Like the other blocks, block 705 comprises a material adapted for receiving a load and provides support to the first pallet. Block 705 can be positioned below the top planar part (not illustrated in FIG. 7) of the first pallet.

FIG. 7 also illustrates the use of horizontally arranged beams to provide additional support to the pallets. In FIG. 7, each horizontally arranged beam may have at least one second orifice 701. The horizontal beams are positioned on top of the blocks and below the top planar part (not illustrated in FIG. 7). In the present embodiment, one beam 715 is positioned on each side proximate to the perimeter of the pallet. Additionally, an additional beam 716 is positioned such that it spans from one side of the pallet to the other. Each end of the beam 716 may rest on top of a portion of a block proximate to the perimeter of the pallet and the middle of the beam 716 may rest on block 705. Additionally, beams 717 each have a first end opposing a second end. The first end of beams 717 rest on block 705 and the second end of the beams rest on portions of blocks positioned on the perimeter of the pallet. The beams provide additional support to the ballet when a load is positioned on top of the pallet.

In one embodiment, the system may comprise a block proximate to a center point of the first pallet. A fifth second vertical support member (not shown) having a first end opposing a second end may be configured to be vertically arranged between the first and second pallets when in the fully assembled state. Like the other second vertical supports, the fifth vertical support supports the second pallet on top of the first pallet and provides vertical relief between the first and second pallets when the system is in a fully assembled state. Similar to other embodiments, the first end of the fifth second vertical support member may be configured to be received by the cutout of the block 705 proximate to the center point of the first pallet. The second end of the fifth second vertical support member may be configured to be received by a fifth capping member (not shown). Similar to the other capping members, the fifth capping member may comprise a receiving part configured to be received by the second end of the fifth second vertical support member. The capping member further comprises a planar part adapted to abut the downward facing surface of the second pallet bottom planar part when the system is in the fully assembled state.

As illustrated in FIG. 7, the first pallet may further comprise at least one horizontally arranged beam comprising at least one second orifice. Each of the horizontally arranged beams are positioned between the top planar part (not illustrated in FIG. 7) and the blocks. The second orifices 701 are configured to correspond with the cutouts and the orifices of the first pallet (illustrated as 230 and 235 in above FIGS.) such that the second orifices receive the first ends of the first and second vertical supports when the system is in the fully assembled state.

It should be noted that FIG. 7 only illustrates the first pallet, however it should be understood that the horizontally arranged beams and additional block 705 may be used with the second pallet as well as third and additional pallets if they utilized by an embodiment of the system.

A plurality of fasteners to removably may attach the ends of the supplemental crossing support members to adjacent supplemental first support members. Supplemental second vertical supports members and supplemental capping members may also be used when a third pallet is used. Furthermore, additional pallets may also be used in a similar fashion as to how the first second and third pallets are used.

Various types of fasteners may be used. Fasteners may include bolts, nuts, wing nuts, bolts having apertures, pins. Such fasteners for securing support members is well known to those skilled in the art in various combinations not specifically mentioned herein may be used and are within the spirit and scope of the invention. Additionally, various combinations of support members may be pre-coupled and affixed to each other to provide easy assembly of the system. For example, in one embodiment, a pair of crossing members forming an x may be affixed to a second vertical support member and adjacent first vertical support members to decrease the amount of time required for assembly of the system.

The pallets can be sized to provide maximum utilization of the space within a shipping container. The pallets can be made from any material having properties able to support a load. Such materials include metal, wood, plastic, corrugated paper, titanium, aluminum, or any combination thereof.

The plurality of support members, which includes the first vertical support members 175, crossing support members 420, second vertical support members 440, supplemental first vertical support members, supplemental vertical support members, supplemental crossing members, capping members and supplemental capping members may comprise material having properties able to support a load. Such materials include metal, wood, plastic, corrugated paper, titanium, aluminum, or any combination thereof. Additionally, the plurality of support members, including the first vertical support members and second vertical support members can have adjustable lengths so as to increase the dimension of vertical relief for space between the first and second pallets when the system is in the fully assembled state. In one embodiment, the first and second vertical support members can have a telescoping body for adjusting the length. Such telescoping bodies and adjusting mechanisms are well known to those skilled in the arts and various other embodiments of adjusting the length of the support members so as to increase the dimension of the space or vertical relief between the first and second pallets are contemplated and are within the spirit and scope of the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A movable modular system for stacking freight within a shipping container comprising:

a first pallet configured to be removably affixed below and have vertical relief from a second pallet when the system is in a fully assembled state, wherein the first pallet comprises:

a first pallet top planar part having a plurality of orifices proximate to a perimeter of the first pallet top planar part;

a first pallet bottom planar part having a plurality of apertures, wherein the apertures are configured to allow a set of wheels of a lifting device to contact ground; and a plurality of blocks affixed between the first pallet top and bottom planar parts, wherein each block has a cutout adapted to correspond with the orifices of the first pallet top planar part, and wherein the plurality of blocks provide vertical relief between the first pallet top and bottom planar parts;

a second pallet configured to be removably affixed on top of and have vertical relief from the first pallet, wherein the second pallet comprises;

a second pallet top planar part;

a second pallet bottom planar part having a plurality of orifices proximate to a perimeter of the second pallet bottom planar part, and further comprising a plurality of apertures inward from the plurality of orifices, wherein the apertures are configured to allow a set of wheels of a lifting device to contact ground; and a plurality of blocks affixed between the second pallet top and bottom planar parts, wherein each block has a cutout adapted to correspond with the orifices of the second pallet bottom planar part, and wherein the plurality of blocks provide vertical relief between the second pallet top and bottom planar parts of the second pallet; and, a plurality of first vertical support members, wherein each first vertical support member comprises an elongated body having a first end opposing a second end, wherein the first end of each first vertical support member is configured to be received by the orifices and corresponding cutouts of the first pallet, wherein the second end of each first vertical support member is configured to be received by orifices and corresponding cutouts of the second pallet, and wherein the first vertical support members are configured to be vertically arranged to support the second pallet on top of the first pallet and provide vertical relief between the first and second pallets when the movable modular system is in the fully assembled state;

a plurality of crossing support members, each crossing member comprising an elongated body having a first end opposing a second end and wherein each crossing member is adapted to span from proximate to the first end of a vertical support member to proximate to the second end of an adjacent vertical support member when the system is in the fully assembled state;

and a plurality of fasteners to removably attach the ends of the crossing support members to the first support members when the system is in the fully assembled state.

2. The movable modular system of claim 1, wherein the first pallet top planar part comprises an upward facing surface configured for receiving freight.

3. The movable modular system of claim 1, wherein the first pallet upward facing surface comprises a first area inward from the orifices on the first pallet top planar part, wherein the first area is configured for receiving freight when the system is in the fully assembled state.

4. The movable modular system of claim 1, wherein the second pallet top planar part comprises an upward facing surface configured for receiving freight.

5. The movable modular system of claim 1, further comprising a plurality of second vertical support members, wherein each second vertical support member comprises an elongated bar shape having a first end opposing a second end, wherein each second vertical support member is configured to be vertically arranged at a midpoint between adjacent first vertical support members when the system is in the fully assembled state.

6. The movable modular system of claim 5, wherein the first end of each second vertical support member is configured to be received by an orifice and corresponding cutout of the first pallet, wherein the second end of each second vertical support member is configured to be received by a capping member, wherein the capping member comprises a receiving part configured to receive the second end of the second vertical support member, and wherein the capping member further comprises a planar part adapted to abut a downward facing surface of the second pallet bottom planar part.

7. The movable modular system of claim 6, wherein the first and second pallets each have four sides.

8. The movable modular system of claim 7, wherein when in the fully assembled state each side of the system comprises two crossing members forming an x-shape spanning adjacent first vertical support members, wherein the crossing members are removably affixed to each other at a midpoint of each crossing member.

9. The movable modular system of claim 8, wherein the plurality of first vertical support members, crossing support members and second vertical support members comprise material having properties to support a load.

10. The movable modular system of claim 9, wherein when the system is in the fully assembled state the system comprises:

said first pallet positioned below and having vertical relief from said second pallet;

four first vertical members, each first vertical support member vertically arranged proximate to a corner of the system between said top and bottom pallets, wherein said first end of each first vertical member is received by orifices and corresponding cutouts in said first pallet and said second end is received by said orifices and corresponding cutouts in said second pallet;

four second vertical support members, each second vertical support member vertically arranged between two adjacent first vertical members, wherein said first end of said second vertical support member is received by orifices and corresponding cutouts in said first pallet and wherein said second end of each second vertical support member is received by said capping member;

four capping members, each receiving section of said capping members received by said second vertical support member, and wherein said upward facing surface of said capping members abuts said downward facing surface of said second pallet bottom planar part; and, eight crossing members, two crossing members forming an x-shape spanning adjacent first vertical support members on each side of the system, wherein each pair of crossing members are removably affixed to each other at said midpoint of each crossing member.

11. A movable modular system for stacking freight within a shipping container comprising:

a first pallet having four sides configured to be removably affixed below and have vertical relief from a second pallet when the system is in a fully assembled state, wherein the first pallet comprises:

a first pallet top planar part having a plurality of orifices proximate to a perimeter of the top planar part;

a first pallet bottom planar part having a plurality of apertures, wherein the apertures are configured to allow a set of wheels of a lifting device to contact ground; and a plurality of blocks affixed between the first pallet top and bottom planar parts, wherein each block has a cutout adapted to correspond with the orifices of the first pallet top planar part, and wherein the plurality of blocks provide vertical relief between the first pallet top and bottom planar parts such as to allow a portion of a lifting device to be positioned below the first pallet top planar part;

a second pallet having four sides configured to be removably affixed on top of and have vertical relief from the first pallet, wherein the second pallet comprises;

a second pallet top planar part;

a second pallet bottom planar part having a plurality of orifices proximate to a perimeter of the second pallet bottom planar part, and further comprising a plurality of apertures inward from the plurality of orifices, wherein the apertures are configured to allow a set of wheels of a lifting device to contact ground; and a plurality of blocks affixed between the second pallet top and bottom planar parts, wherein each block has a cutout adapted to correspond with the orifices of the second pallet bottom planar part, and wherein the plurality of blocks provide vertical relief between the second pallet top and bottom planar parts such as to provide access for a portion of lifting device to be positioned below the second pallet top planar part; and, four first vertical support members, wherein each first vertical support member comprises an elongated body having a first end opposing a second end, wherein the first end of each first vertical support member is configured to be received by the orifices and corresponding cutouts of the first pallet, wherein the second end of each first vertical support member is configured to be received by the orifices and corresponding cutouts of the second pallet, and wherein the first vertical support members are configured to be vertically arranged to support the second pallet on top of the first pallet and provide vertical relief between the first and second pallets when the movable modular system is in the fully assembled state;

eight crossing support members, each crossing member comprising an elongated body having a first end opposing a second end and a midpoint between first and second end and wherein each crossing member is adapted to span from proximate to the first end of a first vertical support member to proximate to the second end of an adjacent vertical support member when the system is in the fully assembled state;

four second vertical support members, wherein each second vertical support member comprises an elongated bar shape having a first end opposing a second end, wherein each second vertical support member is configured to be vertically arranged between adjacent first vertical support members when the system is in the fully assembled state, wherein the first end of each first vertical support member is configured to be received by the orifices and apertures in the first pallet, and wherein the second end of each second vertical support member is configured to be received by a capping member;

four capping members, wherein each capping member comprises a receiving part configured to receive the second end of the second vertical support member, and wherein the capping member further comprises a planar part adapted to abut a downward facing surface of the second pallet bottom planar part when the system is in a fully assembled state; and, a plurality of fasteners to removably attach the ends of the crossing support members to the first support members when the system is in the fully assembled state, and a plurality of fasteners to removably attach the midpoints of a pair of crossing support members to each other.

12. The movable modular system of claim 11, wherein the first pallet top planar part comprises an upward facing surface configured for receiving freight, wherein the upward facing surface of the first pallet top planar part comprises a first area inward from the orifices on the first pallet top planar part, wherein the first area is configured for receiving freight when the system is in the fully assembled state.

13. The movable modular system of claim 12, wherein the midpoints of each pair of crossing support members are removably affixed to one of the second vertical support members by a fastener.

14. The movable modular system of claim 11, wherein the first pallet further comprises one of said plurality of blocks proximate to a center point of the first pallet, wherein fifth second vertical support member having a first end opposing a second end is configured to be vertically arranged between the first and second pallets, wherein the first end of the fifth second vertical support member is configured to be received by the cutout of the block proximate to the center point of the first pallet, wherein the second end of the fifth second vertical support member is configured to be received by a fifth capping member, wherein the fifth capping member comprises a receiving part configured to receive the second end of the fifth second vertical support member, and wherein the capping member further comprises a planar part adapted to abut the downward facing surface of the second pallet bottom planar part when the system is in the fully assembled state.

15. The movable modular system of claim 14, wherein the first pallet further comprises at least one horizontally arranged beam comprising a plurality of second orifices, each of the at least one horizontally arranged beams are positioned between the top planar part and the blocks, wherein the second orifices are configured to correspond with the cutouts and the orifices of the first pallet such that the second orifices receive the first ends of the first and second vertical supports when the system is in the fully assembled state.

16. A kit for movably stacking freight within a shipping container comprising:

a first pallet having configured to be removably affixed below and have vertical relief from a second pallet when the system is in a fully assembled state;

wherein the first pallet comprises:

a first pallet top planar part having a plurality of orifices proximate to a perimeter of the first pallet top planar part;

a first pallet bottom planar part having a plurality of apertures, wherein the apertures are configured to allow a set of wheels of a lifting device to contact ground; and a plurality of blocks affixed between the first pallet top and bottom planar parts, wherein each block has a cutout adapted to correspond with the orifices of the first pallet top planar part, and wherein the plurality of blocks provide vertical relief between the first pallet top and bottom planar parts;

wherein the second pallet comprises:

a second pallet top planar part;

a second pallet bottom planar part having a plurality of orifices proximate to a perimeter of the second pallet bottom planar part, and further comprising a plurality of apertures inward from the plurality of orifices, wherein the apertures are configured to allow a set of wheels of a lifting device to contact ground; and, a plurality of blocks affixed between the second pallet top and bottom planar parts, wherein each block has a cutout adapted to correspond with the orifices of the second pallet bottom planar part, and wherein the plurality of blocks provide vertical relief between the second pallet top and bottom planar parts such as to provide access for a portion of a lighting device to be positioned below the second pallet top planar part; and, a plurality of support members arranged between the first and second pallets supporting the second pallet on top of the first pallet and providing vertical relief between the first and second pallets when the movable modular system is in the fully assembled state, and wherein the plurality of support members each have a first end opposing a second end, wherein the first ends of support members are configured to be received by the orifices and cutouts of the first pallet when the system is in the fully assembled state; and, wherein the second ends of the support members are configured to be received by the orifices and cutouts of the second pallet when the system is in the fully assembled state.

* * * * *